US006055682A

United States Patent [19]

Sanchez

[11] Patent Number: 6,055,682

[45] Date of Patent: May 2, 2000

[54] SWIMMING POOL LANE LINE PROTECTION DEVICE

[76] Inventor: Robert Sanchez, 361 Del Mar Ave., San Diego, Calif. 91910

[21] Appl. No.: 09/039,971

[22] Filed: Mar. 16, 1998

Related U.S. Application Data

[60] Provisional application No. 60/040,932, Mar. 17, 1997.

[51] Int. Cl.[7] ..... E04H 4/00

[52] U.S. Cl. ..... 4/496; 242/615

[58] Field of Search ..... 4/496, 505; 242/397, 242/615, 615.21, 615.3, 615.4; 126/196.1

[56] References Cited

U.S. PATENT DOCUMENTS

| | | | |
|---|---|---|---|
| 2,991,502 | 7/1961 | Becker et al. | 242/615 X |
| 3,531,059 | 9/1970 | Walker | 242/86.2 |
| 4,836,432 | 6/1989 | Violette | 242/615 |

*Primary Examiner*—Charles E. Phillips

*Attorney, Agent, or Firm*—Fitch, Even, Tabin & Flannery

[57] ABSTRACT

A portable lane line protection device, or "line-saver", is positioned on the edge of a swimming pool and bypasses the sharp edge of the pool by creating a smooth surface over the pool's edge. A lane line is placed over the smooth surface of the line-saver, thereby preventing the lane line from contacting the relatively sharp edge of the pool, as the lane line is extended into and out of the pool from a storage point or location (usually on a reel) well above the surface of the pool deck to the water level of the pool (which is usually a foot or so below the surface of the pool deck). The line-saver has a U-shaped channel centrally located therein through which the lane line slides or glides as it transitions between the water level and its storage level or vice-versa. Such channel includes smooth edges that are sufficiently high to prevent the lane line from slipping or pulling out of the channel. The line-saver is made from a light weight material, e.g., fiberglass coated with a gel-coat, or any other suitable material (such as plastic) which is easily molded or formed into the desired line-saver shape during manufacture.

17 Claims, 3 Drawing Sheets

SWIMMING POOL LANE LINE PROTECTION DEVICE

This application claims benefit of provisional application 60/040,932 filed Mar. 17, 1997.

BACKGROUND OF THE INVENTION

The present invention relates to swimming pool accessories, and more particularly to a protection device for use with swimming pool lane lines used for demarcation of swimming pool lanes when such lane lines are extended into and retracted out of the water. Even more particularly, such protection device serves to protect both the edge of the swimming pool as well as the swimming pool lane line from cracking or breaking during such extending and retracting process.

In large swimming pools, e.g., Olympic-sized swimming pools, of the type commonly found in parks, clubs, schools, colleges, universities or the like, competitive swimming events are frequently held. During such competitive swimming events, it is necessary to mark lanes within the pool for each competitor. Such demarcation of swimming pool lanes may be achieved in any suitable fashion, e.g., a taught rope held near the surface of the water with spaced-apart buoys. In recent years, lane line markers have evolved to the point where they not only mark the swimming lanes, but they also suppress surface waves, thereby keeping the surface of the pool as calm as possible during the swimming events. Examples of lane lines especially designed for use in swimming pools, including anti-wave lane lines, can be found, e.g., in U.S. Pat. Nos. 3,793,657; 4,616,369; 4,894,873 and 5,520,562, incorporated herein by reference. Lane lines of the type disclosed in these patents, or similar thereto, are commercially available from numerous swimming pool supply companies, e.g., the "Competitor" lane lines, or the "Anti-Wave Lane Lines" available from Leslie's Swimming Pool Supplies of Los Angeles, Calif. (800-227-8222).

Most modern swimming pool lane lines comprise a central cable on which buoyant spaced-apart rings, disks or cylinders, some having radially extending fins, are threaded. The rings, disks, fins, or other elements threaded on the supporting cable are generally made from brightly-colored polypropylene or other plastic materials. Unfortunately, when in use, the plastic materials of the lane lines are exposed to both chlorine and radiation from the sun, probably two of the worst enemies of plastic materials. Both of these factors work on the plastic, eventually causing it to become stiff and brittle.

Because of the length of the lane lines, such lane lines are usually best managed and stored on a large reel that can be positioned near the edge of the pool, and from which the lane line can be unwound while extending it into the pool, or to which the lane line can be wound while retracting it from the pool. During such extending or retracting process, the edges or fins of the rings, disks, or cylinders of the lane line rub against the edge of the pool. If the edges or fins of the rings, disks, or cylinders of the lane line are hardened or stiffened, as typically occurs when exposed to chlorine and sunlight, such rubbing quickly chips away at the brittle elements, leaving unsightly pieces of plastic in the water. Over time, the continued rubbing of the sharp or broken edges of the lane line may also actually damage the edge of the pool. What is clearly needed, therefore, is a protection device that prevents the edges or fins of the rings, disks or other elements of the lane lines from rubbing against the edge of the pool during the extension and retraction process, thereby extending the life of the lane lines and protecting the edge of the swimming pool.

SUMMARY OF THE INVENTION

The present invention addresses the above and other needs by providing a swimming pool lane line protection device, hereafter referred to as the "line-saver", which can be easily positioned on the edge of the swimming pool and which bypasses the sharp edge of the pool by creating a smooth radius over the pool's edge. In use, the lane line is placed over the smooth radius or surface provided by the line-saver, thereby preventing the lane line from contacting the edge of the pool, as the lane line is extended into and out of the pool from a storage point or location (usually on a reel) well above the surface of the deck surrounding the pool to the water level which is usually a foot or so below the surface of the pool deck.

In accordance with one aspect of the invention, the line-saver has a shallow U-shaped channel centrally located therein through which the lane line slides as it transitions between the water level and its storage level (e.g., a reel). Such channel includes edges that are sufficiently high to prevent the lane line from easily slipping out of the line-saver.

In accordance with another aspect of the invention, the line-saver is made from a smooth material, e.g., fiberglass coated with a gel-coat, or any other suitable material (such as plastic) which is easily molded into the desired line-saver shape during manufacture, which smooth material provides the desired smooth surface on which the lane line glides as it is directed into and out of the pool. Advantageously, such material is not only light weight and relatively inexpensive, but it is also virtually maintenance free.

One embodiment of the invention may be broadly characterized as a swimming pool lane line protection device that includes a one-piece support having a base portion that contacts a pool deck, an overhang portion that extends over and hangs below the pool deck, and a channel portion extending through both the base portion and the overhang portion; and wherein the channel portion comprises a trough or similar channel having smooth walls which provides a smooth surface on which a lane line may slide as the lane line is pulled into or out of the swimming pool. In a preferred embodiment, the trough comprises a generally U-shaped channel with a smooth bottom surface and side edges which, in combination, guide the lane line as it is pulled into or out of the swimming pool.

Other embodiments of the invention, as well as variations of the embodiments just described, will be evident from the more detailed description of the invention presented below.

It is an object of the present invention to provide an apparatus for use with a swimming pool lane line which allows the lane line to bypass the sharp edge of a swimming pool as the lane line is extended into and retracted from the pool, thereby allowing the lane line to last longer, and further avoiding potential damage to the pool's sharp edge.

It is a feature of the invention to provide such a protection device or "line-saver" which fits easily over the edge of the swimming pool and gently guides the lane line as it is reeled up out of the water, or as it is pulled into the water.

It is still another feature of the invention to provide a protection device for use with swimming pool lane lines which is a light-weight, portable, one-piece unit (weighing no more than a few pounds) that can easily be carried and positioned over the pool's edge at a desired location, including corners, without the use of auxiliary tools or clamps.

It is an additional feature of the invention to provide such a protection device which is made from materials which are virtually maintenance free.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
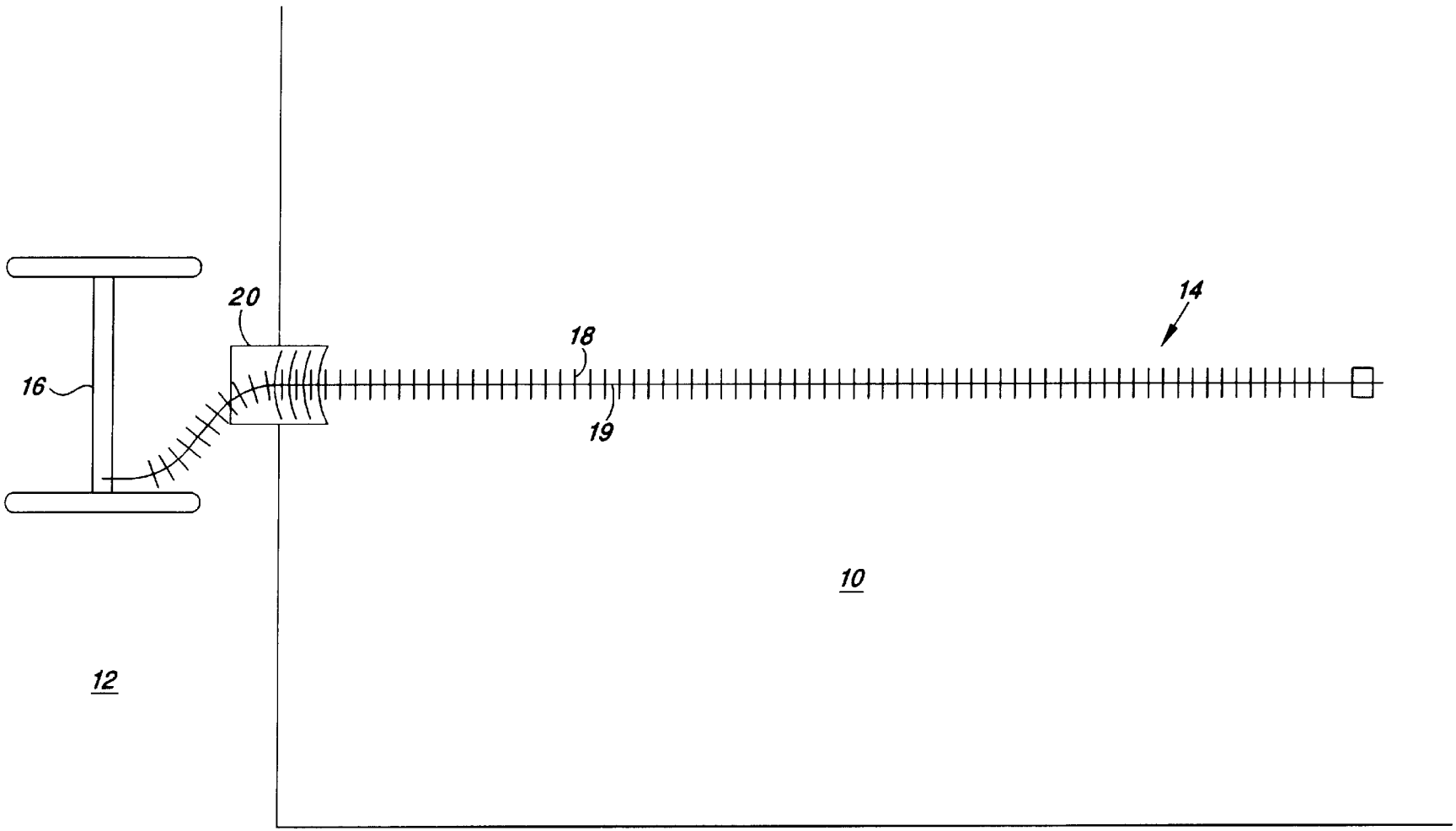
FIG. 1 shows a partial schematic top view of a swimming pool, swimming pool deck, lane line, lane reel, and the lane line protection device, or "line-saver", of the present invention, illustrating the manner in which the line-saver is typically used.

Turning first to FIG. 1, there is shown a partial schematic top view of a swimming pool 10, swimming pool deck 12, lane line 14, lane reel 16, and a line-saver 20 in accordance with the present invention. The lane line 14 may be of any design, typically comprising individual spaced-apart plastic rings or disks 18 that are threaded onto a supporting cable 19. Because the rings or disks 18 are made from plastic, they float, holding the supporting cable 19 near the surface of the water. The rings or disks 18, for most commercially available lane lines, have a diameter of from 3½ to 4½ inches. When stored, the lane line 14 is typically wound on the lane reel 16. When retrieved from storage, lane line 14 must therefore be unwound from the reel 16. In either event, i.e., regardless of whether the lane line 14 is being wound onto the reel 16, or unwound from the reel 16, the line-saver 20 of the present invention provides a smooth surface over which the lane line 14 may glide as it transitions from the reel to the pool, bypassing the relatively sharp edge of the pool.

Figure 2:
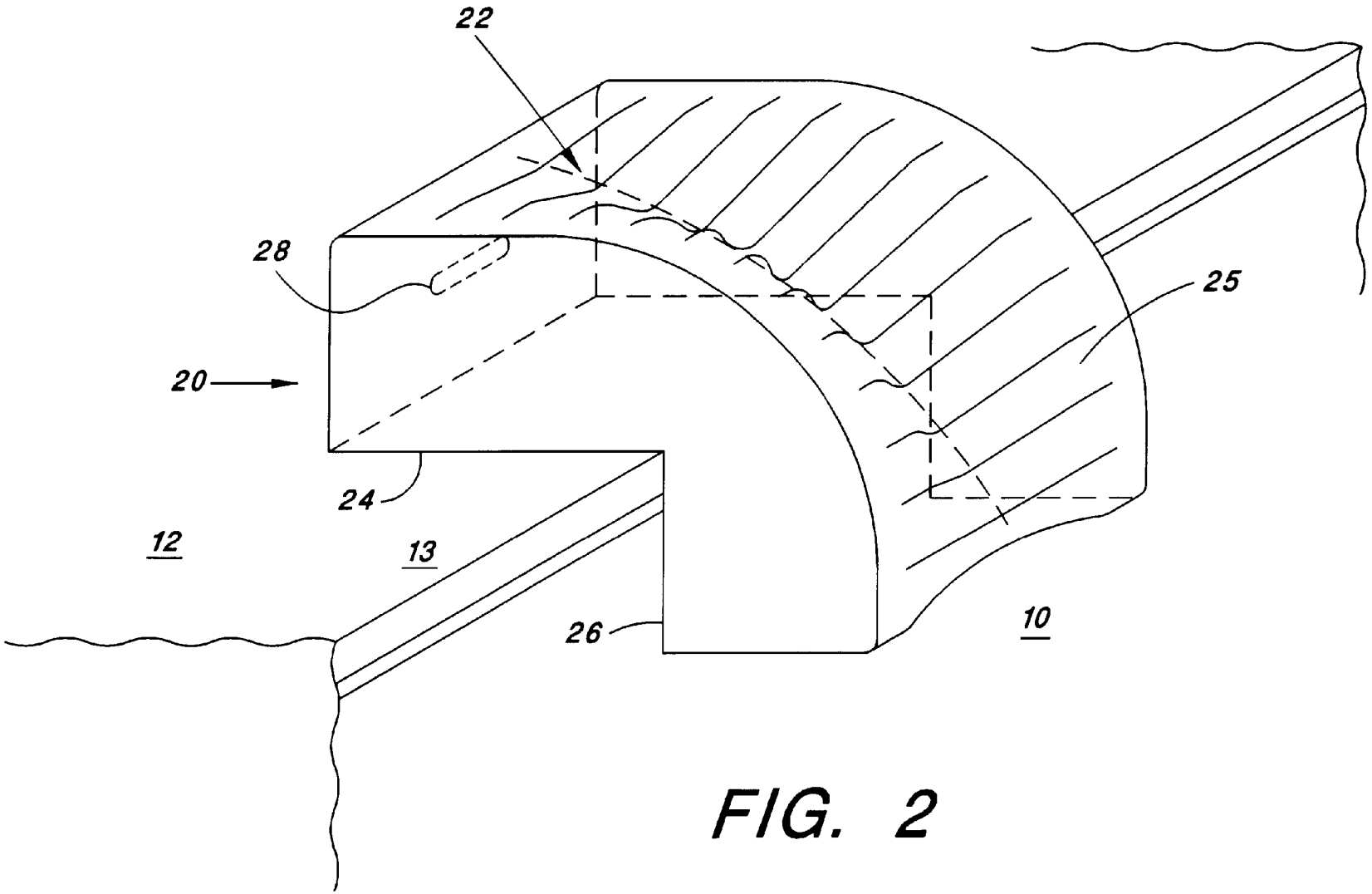
FIG. 2 is a perspective view of the line-saver of the invention positioned over the edge of a swimming pool, and further illustrates the U-shaped guide channel provided by the invention through which the lane line slides as it is extended into or retracted from the swimming pool.
Figure 4:
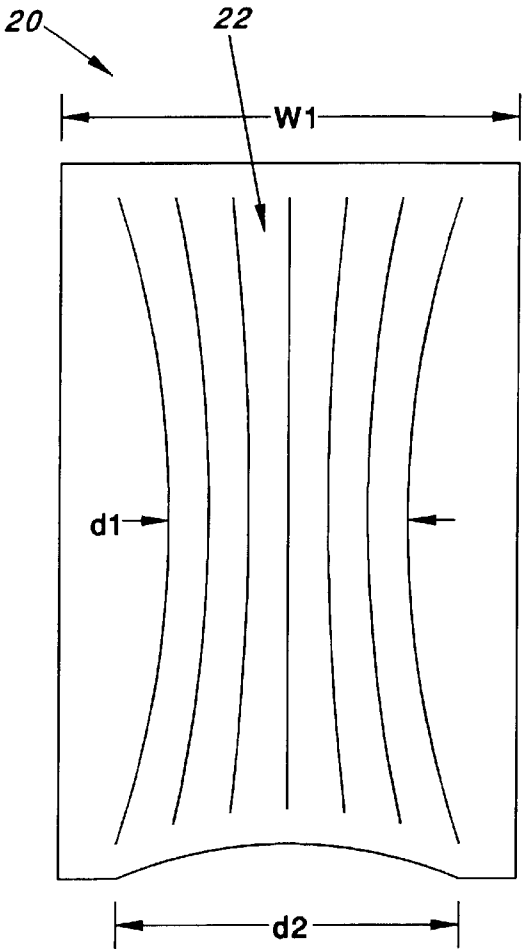
FIG. 4 is a front view of the line-saver.
Figure 3:
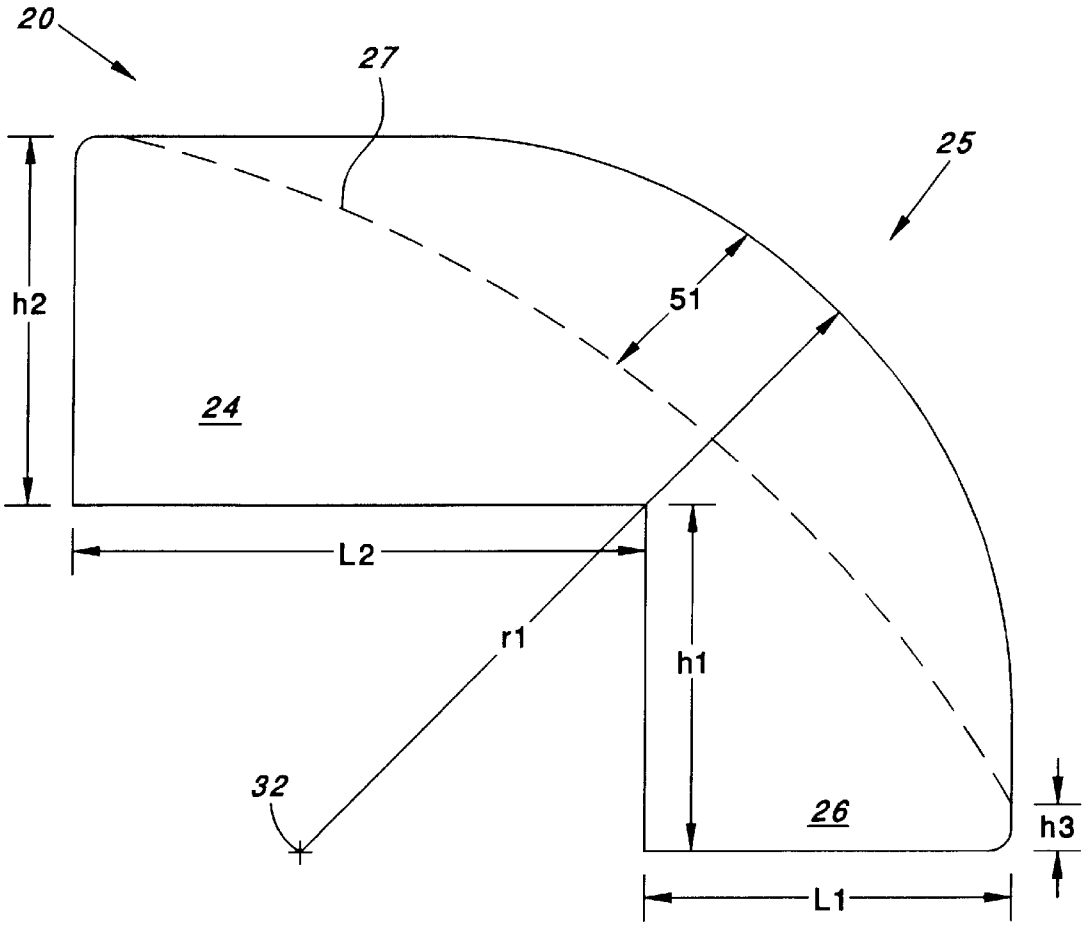
FIG. 3 is a side view of the line-saver.

Next, with respect to FIGS. 2, 3 and 4, a more detailed description of the line saver 20 will be provided. FIG. 2 is a perspective view of the line-saver 20 positioned over an edge 13 of a swimming pool 10, and further illustrates a U-shaped guide channel 22 through which the lane line 14 slides as it is extended into or retracted from the swimming pool. FIG. 3 is a side view of the line-saver 20, and FIG. 4 is a front view of the line-saver. It should be noted that these figures are not drawn to scale, but are merely sketches that teach the general principles of the invention.

As seen in FIGS. 2–4, the line-saver 20 includes a base portion 24 and an overhang portion 26. The base portion 24 generally includes that portion of the device 20 which rests securely on the flat surface of the pool deck 12 along the edge 13 of the pool. The overhang portion 26, as its name implies, includes that portion of the device 20 that extends out from the edge 13 and overhangs above the surface of the water in the pool. Extending through both the base portion 24 and the overhang portion 26 is a channel portion 25, which channel portion 25 essentially comprises the upper surface of both the base portion 24 and the overhang portion 26. In this upper surface a trough or channel 22 is formed, which trough or channel provides a smooth surface on which the lane line 14 may slide as it is moved into and out of the pool 10.

In a preferred embodiment, the trough or channel 22 comprises a U-shaped channel adapted to receive the lane line 14. However, it is to be understood that other types of channels, e.g., a V-shaped channel, could likewise be used providing a smooth surface or surfaces upon which the lane line may slide.

As best seen in FIG. 3, the base portion 24 has a length L2 and a height h2. The full length L2 of the base portion 24 is designed to rest or lie on the edge of the pool. The overhang portion 26 similarly has a width L1 and a height h1. The width of the overhang portion represents the lateral distance the line-saver 20 overhangs above the pool, which the height h1 of the overhang portion represents the vertical distance the line-saver device 20 extends below the surface of the pool deck 12. Typically, L1 should be no greater than about ½ of the distance L2, while h1 should be about ½ to ⅔ of the distance h2. These dimensions assure that the center of gravity of the line-saver 20 is positioned well over the pool deck 12, thereby assuring that it will not easily tip into the pool 10, and that a suitable sliding surface 27, i.e., the bottom of the channel or trough 22 (shown as a dotted line in FIG. 3), on which the lane line 14 may slide makes a smooth transition from a point below the pool deck (near the surface of the water in the pool) to a point above the pool deck (near a suitable reel 16). As shown in FIG. 3, the trough or channel 22 does not begin until a distance h3 from the bottom of the overhang portion 26. In a preferred embodiment, the length L2 of the base portion 24 is about 14 inches, while the length L1 of the overhang portion 26 is about 8 inches. The height h1 of the overhang portion is about 7½ inches, and the height h2 of the base portion is about 11½ inches. The height h3 at which the channel 22 begins from the bottom of the overhang portion is about 1½ inches.

The size of the channel 22 in the line-saver 20 must be sufficiently large to easily accommodate the lane line 14. A typical lane line has a width of between about 4 to 4½ inches, e.g., 4½ inches, so the channel 22 ought to have a width that is at least about 1¼ times this dimension. In a preferred embodiment, the channel 22 has a width d1 near its middle portion that is somewhat narrower than the width d2 of the channel 22 hear its top and bottom portions, as shown in FIG. 4. For example, a typical width d1 of the channel may be 5 to 6 inches, whereas a typical width d2 of the channel may be 6 to 7 inches. As also seen in FIG. 4, the line-saver 20 has a width W1, which width W1 must be greater than d2. In a preferred embodiment, W1 is about 16 inches, whereas d2 is only about 6 to 7 inches.

Advantageously, as the channel 22 is formed through the channel portion 25 of the device 20, side walls are also formed that define the channel shape. These side walls prevent the lane line from slipping out of the channel as it slides through the channel. Such side walls generally have a maximum height s1 near the middle of the channel 22, with the height of the channel diminishing to near zero at the top of the channel 22 and diminishing to a much smaller value near the bottom of the channel. The upper edge of the side walls generally follows a radius r1 from a point 32 below the base portion 24 a distance approximately h1. In the preferred embodiment, the value of s1 is about 5 to 9 inches, and the value of r1 is roughly 20 to 24 inches.

As seen in FIG. 2, the line-saver 20 preferably includes a handle 28, or other suitable hand-hold feature, that allows the device 20 to be easily picked up and transported to a desired location. Where the device 20 is essentially a non-solid structure, which is the preferred design, the handle 28 may be as simple as an opening in the back panel of the base portion 24.

The line-saver 20 is preferably made from a continuous fiberglass panel that is coated on its upper surfaces with a suitable smooth gel-coat, as is known in the art. Such techniques of making a fiberglass structure over a pre-formed mold are well known in the art. Typically, the sequence of manufacture involves: (1) spraying a mold with the desired gel coat color(s); (2) applying the fiberglass over the gel-coated surface; (3) saturating the fiberglass with resin; (4) allowing the saturated fiberglass to cure; and (5) removing the cured fiberglass from the mold, which cured fiberglass represents the finished product. The thickness of the fiberglass may be between about ⅛ to ¼ inch, e.g., 3/16 of an inch.

Alternatively, the line-saver 20 may be made from a sheet of thermo-forming plastic, using a thermo-vacuum forming process, as is also known in the art. Such process typically involves the steps of: (1) obtaining a sheet of thermo-forming plastic having sufficient area to cover the mold; (2) heating the sheet of thermo-forming plastic while not on the mold; (3) while heated, draping the sheet of plastic over the mold; (4) applying vacuum suction to make the contours of the plastic fit the mold; (5) removing the formed plastic from the mold; (6) allowing the formed plastic to cool; and (7) trimming the edges.

It should also be noted that the line-saver 20 need not be a hollow device made from a continuous fiberglass or plastic panel, conformed to a mold, as described above. Rather, the device could be formed from a solid substance, e.g., Styrofoam, wood, or plastic, wherein the channel 22 is simply carved or otherwise milled out of the solid substance. The main consideration when selecting a material, whether solid or hollow, from which the line-saver device 20 is to be made is the weight. That is, the total weight of the line-saver 20 should be kept as low as possible so that the line-saver can be picked up manually without difficulty and transported to a desired location. When the line-saver 20 is made from fiberglass, for example, the total weight is only a few pounds, e.g., 3 or 4 pounds.

While the invention herein disclosed has been described by means of specific embodiments and applications thereof, numerous modifications and variations could be made thereto by those skilled in the art without departing from the scope of the invention set forth in the claims.

What is claimed is:

1. A swimming pool lane protection device comprising:

a one-piece support having a base portion that contacts a pool deck, an overhang portion that extends over and hangs below the pool deck, and a channel portion extending over and through both the base portion and the overhang portion;

said channel portion comprising a trough having smooth walls which provide a smooth surface on which a lane line may slide as a lane line is pulled into or out of the swimming pool;

wherein the base portion extends on the pool deck a distance L2 that is about at least twice a distance L1 that the overhand portion extends over the edge of the pool.

2. The lane line protection device of claim 1 wherein the trough of the channel portion comprises a generally U-shaped channel with a smooth bottom surface and side edges which provide a smooth transition on which the lane line may slide as the lane line is pulled into or out of the swimming pool.

3. The lane line protection device of claim 1 wherein the trough of the channel portion has dimensions which allow a lane line having a width of between about 3½ to 4½ inches to freely slide therein.

4. The lane line protection device of claim 3 wherein the width of the trough of the channel portion is narrower in a middle section of the channel than it is near a bottom section of the channel located in the overhang portion and a top section of the channel located in the base portion.

5. The lane line protection device of claim 1 wherein the overhang portion extends down below the pool deck a distance h1 that is approximately the same distance L1 that the overhang portion extends over the edge of the pool.

6. The lane line protection device of claims 1 or 5 wherein the base portion extends up from the pool deck a distance h2 that is approximately 1½ times the distance h1 that the overhang portion extends down below the pool deck.

7. The lane line protection device of claim 1 wherein the base portion and overhang portion are made from fiberglass coated with a gel-coat.

8. A swimming pool lane protection device comprising:

a one-piece support having a base portion that contacts a pool deck, an overhang portion that extends over and hangs below the pool deck, and a channel portion extending over and through both the base portion and the overhang portion;

said channel portion comprising a trough having smooth walls which provide a smooth surface on which a lane line may slide as a lane line is pulled into or out of the swimming pool; wherein the trough of the channel portion has dimensions which allow a lane line having a width of between about 3½ to 4½ inches to freely slide therein.

9. The lane line protection device of claim 8 wherein the overhang portion extends down below the pool deck a distance h1 that is approximately the same distance L1 that the overhang portion extends over the edge of the pool.

10. The lane line protection device of claim 8 wherein the base portion extends up from the pool deck a distance h2 that is approximately 1½ times the distance h1 that the overhang portion extends down below the pool deck.

11. The lane line protection device of claim 8 wherein the trough of the channel portion comprises a generally U-shaped channel with a smooth bottom surface and side edges which provide a smooth transition on which the lane line may slide as the lane line is pulled into or out of the swimming pool.

12. A swimming pool lane protection device comprising:

a one-piece support having a base portion that contacts a pool deck, an overhang portion that extends over and hangs below the pool deck, and a channel portion extending over and through both the base portion and the overhang portion;

said channel portion comprising a trough having smooth walls which provide a smooth surface on which a lane line may slide as a lane line is pulled into or out of the swimming pool; wherein the base portion and overhang portion are made from fiberglass coated with a gel-coat.

13. The lane line protection device of claim 12 wherein the width of the trough of the channel portion is narrower in a middle section of the channel than it is near a bottom section of the channel located in the overhang portion and a top section of the channel located in the base portion.

14. The lane line protection device of claim 12 wherein the base portion extends up from the pool deck a distance h2 that is approximately 1½ times the distance h1 that the overhang portion extends down below the pool deck.

15. The lane line protection device of claim 12 wherein the trough of the channel portion has dimensions which allow a lane line having a width of between about 3½ to 4½ inches to freely slide therein.

16. The lane line protection device of claim 12 wherein the trough of the channel portion comprises a generally U-shaped channel with a smooth bottom surface and side edges which provide a smooth transition on which the lane line may slide as the lane line is pulled into or out of the swimming pool.

17. The lane line protection device of claim 12 wherein the overhang portion extends down below the pool deck a distance h1 that is approximately the same distance L1 that the overhang portion extends over the edge of the pool.

* * * * *